US007091169B2

(12) United States Patent
Nickel et al.

(10) Patent No.: US 7,091,169 B2
(45) Date of Patent: Aug. 15, 2006

(54) FABRIC-CARE AGENT

(75) Inventors: Dieter Nickel, Erkrath (DE); Patrizia Bianconi, Gerenzano (IT); Theodor Völkel, Erkrath (DE); Horst-Dieter Speckmann, Langenfeld (DE); Maren Jekel, Düsseldorf (DE)

(73) Assignee: Ciba Specialty Chemicals Corporation, Tarrytown, NY (US)

( * ) Notice: Subject to any disclaimer, the term of this patent is extended or adjusted under 35 U.S.C. 154(b) by 306 days.

(21) Appl. No.: 10/239,903

(22) PCT Filed: Mar. 22, 2001

(86) PCT No.: PCT/EP01/03257

§ 371 (c)(1),
(2), (4) Date: Feb. 5, 2003

(87) PCT Pub. No.: WO01/74982

PCT Pub. Date: Oct. 11, 2001

(65) Prior Publication Data

US 2003/0150064 A1 Aug. 14, 2003

(30) Foreign Application Priority Data

Mar. 31, 2000 (DE) ..... 100 15 991

(51) Int. Cl.
*C11D 1/06* (2006.01)
*D06L 3/02* (2006.01)

(52) U.S. Cl. ..... 510/392; 548/300.1; 435/202

(58) Field of Classification Search ..... 510/336, 510/341, 350–1, 357, 481, 488, 499, 501, 510/392; 548/300.1; 435/202
See application file for complete search history.

(56) References Cited

U.S. PATENT DOCUMENTS

| | | | | |
|---|---|---|---|---|
| 5,707,951 | A | 1/1998 | Masschelein et al. | 510/320 |
| 5,789,373 | A | 8/1998 | Baker et al. | 510/522 |
| 6,184,019 | B1 * | 2/2001 | Miettinen-Oinonen et al. | 435/209 |
| 6,506,716 | B1 * | 1/2003 | Delplancke et al. | 510/336 |

FOREIGN PATENT DOCUMENTS

| | | | |
|---|---|---|---|
| WO | 96/27649 | | 9/1996 |
| WO | 98/29529 | | 7/1998 |
| WO | WO 99/06519 | * | 2/1999 |

OTHER PUBLICATIONS

Registry No. 9012-54-8 Nov. 1984; Registry No. 68214-71-1 Nov. 1984; Registry No. 199395-59-0 Jan. 1998; Registry No. 108563-14-0 Jun. 1987; Registry No. 108570-44-1 Jun. 1987: Registry No. 115558-47-9 Jul. 1988; Registry No. 39660-17-8 Nov. 1994; Registry No. 52450-80-3 Nov. 1984; Registry No. 61374-11-6 Nov. 1984 and Registry No. 345664-66-6 Jul. 2001.

* cited by examiner

*Primary Examiner*—Yogendra Gupta
*Assistant Examiner*—Preeti Kumar

(74) *Attorney, Agent, or Firm*—Kevin T. Mansfield

(57) ABSTRACT

A textile-care composition that advantageously combines colour preservation with care of fibres and especially greying-inhibiting action was to be developed. That was achieved by means of a composition for textile care, comprising at least one cellulase and at least one colour-fixing polymer containing imidazolidine units.

17 Claims, No Drawings

FABRIC-CARE AGENT

The present invention relates to a composition for the care of textiles, comprising cellulase and colour-fixing polymer.

An important aspect in the washing of textiles is that dirt and, especially, stains are removed. In the terminology of the field, that principal aspect of washing is usually referred to as the primary washing characteristics. The commercially available washing compositions already meet that requirement in outstanding manner. In the industrialised countries in particular, however, the attention of the consumer is concentrating less and less on those primary washing characteristics. Secondary washing characteristics, such as gentleness to fibres, inhibition of greying and colour preservation, are assuming greater importance, especially in relation to the washing of high-quality textiles. It has hitherto been necessary in that respect for compromises to be made, in washing compositions, between primary washing characteristics that are as good as possible and properties of gentleness to fabrics. There is, in this regard, an increasing need for compositions that allow the advantageous combination of both aspects.

Initial attempts at such developments have been made over a relatively long period of time. For example, cellulases are known as avivage active ingredients for cotton fabrics because of their ability to break down cellulose. With regard to the mechanism of action involved therein, laundry-softening cellulases are assumed preferentially to attack and remove hydrolytically micro-fibrous cellulose (so-called fibrils) protruding from the surface of the cotton fibre and preventing the cotton fibres from sliding freely over one another. A subsidiary effect of such fibril breakdown is also the intensification of the optical sensation of colour. That effect is described, for example, in European Patent Specification EP 0 220 016 as so-called colour freshening, which is brought about in the course of treating dyed cotton textiles with cellulases when the undyed fibrils, which originate from inside the fibres and are produced as a result of fibre damage, are removed. On the other hand, however, cellulases are also known for their cleaning action in removing inorganic solid dirt from the textile being cleaned, as described, for example, in German Offenlegungsschrift DE 32 07 828. Cellulases are thus known to contribute to the primary washing characteristics of washing compositions, that is to say to the property of removing dirt from the textile being cleaned.

German Patent Application DE 43 25 882 discloses that cellulases can also be used as greying-inhibitors in washing and cleaning compositions, wherein the cellulase, in combination with inorganic, especially zeolitic, builder substances, brings about a reduction in redeposition of dirt particles on the washed laundry, that is to say brings about an improvement in the secondary washing characteristics of washing and cleaning compositions.

The use of cellulase alone accordingly already brings clear advantages in respect of the effects in question. With regard to a desirable colour-fixing action, however, further active ingredients are necessary.

It is known that certain polymers have a colour-fixing action. European Patent Application EP 0 462 806 describes a washing method and a laundry treatment composition which, when used, result in a reduction in the amount of colour released during wet textile treatment. In order to achieve that effect, cationic agents are added to washing compositions.

International Patent Application WO 96/27649 describes washing compositions and fabric softeners that comprise cellulase and cationic colour-fixers for the purpose of colour preservation, the enzyme being present in the product in amounts of from 0.05 to 125 CEVU/g and the content of colour-fixers being from 0.01 to 50% by weight. The cellulase to which preference is expressly given therein is an endoglucanase having a molecular weight of 45 kD, as described in International Patent Application WO 91/17243. Preferred colour-fixers are compounds such as Sandofix TPSR®, Sandofix WE56R®, Indosol CRR® and Solidogen FRZR® (Sandoz). Even those compositions, however, still force the consumer into compromises between properties of gentleness to textiles or of caring for textiles and the achievable cleaning performance There is therefore still a need for textile-care compositions that advantageously combine colour preservation with gentleness to fibres and, especially, greying-inhibiting action.

It has now been found, surprisingly, that a composition that combines cellulase with certain colour-fixing polymers, yields outstanding results in those respects.

The invention accordingly relates firstly to a composition for textile care, comprising at least one cellulase and at least one colour-fixing polymer, wherein the colour-fixing polymer contains imidazolidine units.

A colour-fixing polymer containing imidazolidine units is, within the context of this invention, expressly understood to include oligomeric compounds and mixtures of oligomers and polymers. It is essential that the said imidazolidine units are present in the compounds. At least a part of the structure of the colour-fixing polymers accordingly corresponds to formula I wherein n is preferably at least 2 but may well assume a value of 1000 or more.

(I)

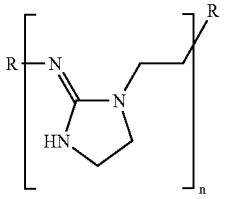

The radicals R therein may, each independently of the other, be hydrogen, alkyl, amino, alkylamino radicals, other N-functional radicals or even polymers, especially amino-functional polymers.

In accordance with the invention special preference is given to colour-fixing polymers that include at least one representative from the group of oligomers or polymers according to formulae II–VIII.

(II)

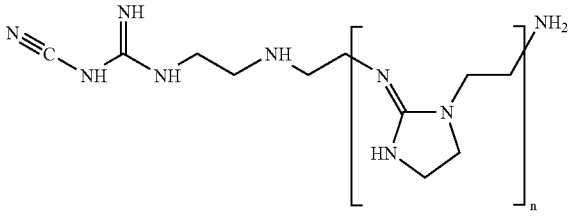

-continued (III)

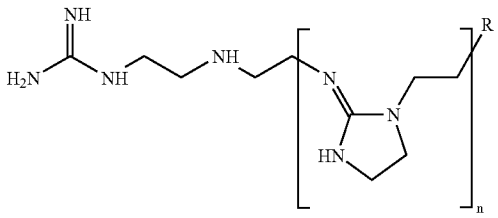

(IV)

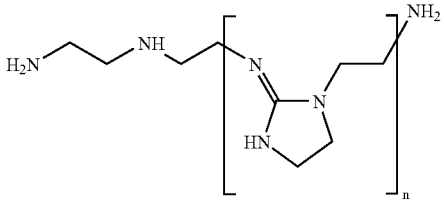

(V)

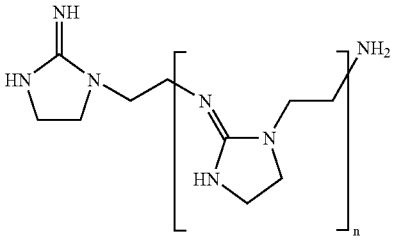

(VI)

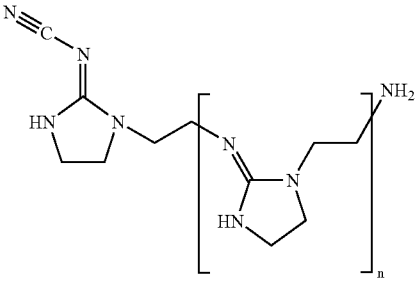

(VII)

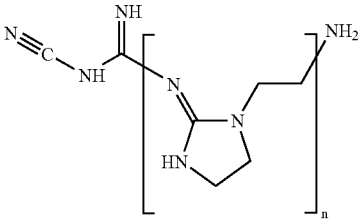

(VIII)

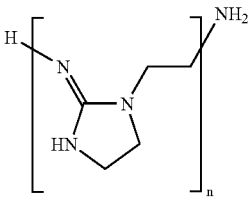

In formulae II–VII, n preferably has values in the range from 2 to 10 000, especially in the range from 3 to 1000.

The polymers especially preferred in accordance with the invention include those that comprise a plurality of compounds from the group comprising formulae II–VII. To the person skilled in the art of textile treatment, such polymers have long been known for textile finishing. Those polymeric mixtures can be prepared, for example, by reacting diethylenetriamine with cyanoguanidine. In accordance with the invention, special preference is given to those polymers which consist substantially of imidazolidine units. Such colour-fixing polymers are commercially available, for example under the tradename Tinofix CL® (Ciba). They are usually present in the compositions according to the invention in amounts of from 0.1 to 25% by weight, preferably in amounts of from 1 to 10% by weight.

The compositions according to the invention, especially when they are in liquid form, preferably comprise solvents, with special preference being given to water in that regard. It may, however, also be advantageous to use non-aqueous solvents, especially mono- or poly-hydric alcohols such as, for example, ethanol, n-propanol, isopropanol, ethylene glycol, 1,2-propylene glycol and/or 1,3-propylene glycol, alone or in admixture with water. For stabilisation of the compositions it may further be preferred to use emulsifiers, the emulsifiers to which special preference is given being non-ionic surfactants.

As non-ionic surfactants, preferably alkoxylated, advantageously ethoxylated and/or propoxylated, especially primary alcohols having preferably from 8 to 18 C atoms and, on average, from 1 to 12 moles of ethylene oxide (EO) and/or from 1 to 10 moles of propylene oxide (PO) per mole of alcohol are used. Special preference is given to $C_8$–$C_{16}$ alcohol alkoxylates, advantageously ethoxylated and/or propoxylated $C_{10}$–$C_{15}$ alcohol alkoxylates, especially $C_{12}$–$C_{14}$ alcohol alkoxylates, having a degree of ethoxylation between 2 and 10, preferably between 3 and 8, and/or a degree of propoxylation between 1 and 6, preferably between 1.5 and 5. The alcohol radical may be preferably linear or, especially in the 2-position, methyl-branched, or may comprise a mixture of linear and methyl-branched radicals, as are usually present in oxo alcohol radicals. Special preference is given, however, to alcohol ethoxylates having linear radicals derived from alcohols of natural origin that contain from 12 to 18 C atoms, for example coconut, palm and tallow fatty alcohol or oleyl alcohol, and on average from 2 to 8 EO per mole of alcohol. The preferred ethoxylated alcohols include, for example, $C_{12-14}$ alcohols with 3 EO or 4 EO, $C_{9-11}$ alcohols with 7 EO, $C_{13-15}$ alcohols with 3 EO, 5 EO, 7 EO or 8 EO, $C_{12-18}$ alcohols with 3 EO, 5 EO or 7 EO, mixtures thereof, such as mixtures of $C_{12-14}$ alcohol with 3 EO and $C_{12-18}$ alcohol with 5 EO. The mentioned degrees of ethoxylation and propoxylation represent statistical averages which, for a specific product, can be a whole number or a fractional number. Preferred alcohol ethoxylates and propoxylates have a restricted homologue distribution (narrow range ethoxylates/propoxylates, NRE/NRP). In addition to those non-ionic surfactants, fatty alcohols having more than 12 EO may also be used. Examples thereof are tallow fatty alcohol with 14 EO, 25 EO, 30 EO or 40 EO.

Also suitable are alkoxylated amines, which are advantageously ethoxylated and/or propoxylated, especially primary and secondary amines having preferably from 1 to 18 C atoms per alkyl chain and, on average, from 1 to 12 moles of ethylene oxide (EO) and/or from 1 to 10 moles of propylene oxide (PO) per mole of amine.

In addition, as further non-ionic surfactants, there may also be used alkyl glycosides of the general formula $R^1O(G)_x$, for example in the form of combinations, especially with anionic surfactants, wherein $R^1$ is a primary straight-chained or methyl-branched (especially methyl-branched in the 2-position) aliphatic radical having from 8 to 22, preferably from 12 to 18, C atoms and G is the symbol indicating a glycose unit having 5 or 6 C atoms, preferably glucose. The degree of oligomerisation x, which indicates the distribution of monoglycosides and oligoglycosides, is any number from 1 to 10; x is preferably from 1.2 to 1.4.

A further class of preferably used non-ionic surfactants, which are used either as sole non-ionic surfactant or in combination with other non-ionic surfactants, comprises alkoxylated, preferably ethoxylated or ethoxylated and propoxylated fatty acid alkyl esters, preferably having from 1 to 4 carbon atoms in the alkyl chain, especially fatty acid methyl esters, as described, for example, in Japanese Patent Application JP 58/217598 or prepared preferably in accordance with the process described in International Patent Application WO-A-90/13533.

Non-ionic surfactants of the amine oxide type, for example N-cocoalkyl-N,N-dimethylamine oxide and N-tallow-alkyl-N,N-dihydroxyethylamine oxide, and of the fatty acid alkanolamide type may also be suitable.

As further surfactants there come into consideration so-called gemini surfactants, which are generally understood to mean those compounds that have two hydrophilic groups and two hydrophobic groups per molecule. Those groups are usually separated from one another by a so-called "spacer". That spacer is usually a carbon chain, which should be long enough for the hydrophilic groups to be sufficiently spaced apart that they can act independently of one another. Such surfactants are generally distinguished by an unusually low critical micellar concentration and by the ability substantially to reduce the surface tension of water. In exceptional cases, however, the expression gemini surfactants is understood to mean not only dimeric but also trimeric surfactants.

Suitable gemini surfactants are, for example, sulfated hydroxy mixed ethers according to German Patent Application DE 43 21 022 or dimer alcohol bis- and trimer alcohol tris-sulfates and ether sulfates according to International Patent Application WO 96/23768. End-group-terminated dimeric and trimeric mixed ethers according to German Patent Application DE 195 13 391 are distinguished especially by their bi- and multi-functionality. For example, the mentioned end-group-terminated surfactants exhibit good wetting properties and are at the same time low-foaming, with the result that they are especially suitable for use in machine washing or cleaning methods.

Gemini polyhydroxy fatty acid amides or poly-polyhydroxy fatty acid amides, as described in International Patent Applications WO 95/19953, WO 95/19954 and WO 95/19955 may, however, also be used.

Further suitable surfactants are polyhydroxy fatty acid amides of the following formula

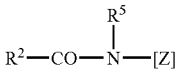

wherein $R^2CO$ is an aliphatic acyl radical having from 6 to 22 carbon atoms, $R^5$ is hydrogen, an alkyl or hydroxyalkyl radical having from 1 to 4 carbon atoms and [Z] is a linear or branched polyhydroxyalkyl radical having from 3 to 10 carbon atoms and from 3 to 10 hydroxyl groups. The polyhydroxy fatty acid amides are known substances that can usually be obtained by reductive amination of a reducing sugar with ammonia, an alkylamine or an alkanolamine and subsequent acylation with a fatty acid, fatty acid alkyl ester or fatty acid chloride.

The group of polyhydroxy fatty acid amides also includes compounds of the following formula

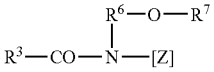

wherein $R^3$ is a linear or branched alkyl or alkenyl radical having from 7 to 12 carbon atoms, $R^6$ is a linear, branched or cyclic alkyl radical or an aryl radical having from 2 to 8 carbon atoms and $R^7$ is a linear, branched or cyclic alkyl radical or an aryl radical or an oxy-alkyl radical having from 1 to 8 carbon atoms, with $C_{1-4}$alkyl or phenyl radicals being preferred, and [Z] is a linear polyhydroxyalkyl radical, the alkyl chain of which is substituted by at least two hydroxyl groups, or alkoxylated, preferably ethoxylated or propoxylated derivatives of that radical.

[Z] is preferably obtained by reductive amination of a reduced sugar, for example glucose, fructose, maltose, lactose, galactose, mannose or xylose. The N-alkoxy- or N-aryloxy-substituted compounds can in that case, for example in accordance with the teaching of International Application WO 95/07331, be converted into the desired polyhydroxy fatty acid amides by reaction with fatty acid methyl esters in the presence of an alkoxide as catalyst.

The cellulase to be used in the compositions according to the invention can be an enzyme, obtainable from bacteria or fungi, that has a pH optimum preferably in the almost neutral to alkaline range from 6 to 10, especially from 6 to 8 (1% solution, by weight, in distilled water). Mixtures of two or more cellulases and, in that case, especially cellulases from different organisms may also be used in the compositions according to the invention. Cellulases that are suitable for use in compositions according to the invention are known, for example, from German Patent Applications DE 31 17 250, DE 32 07 825, DE 32 07 847, DE 33 22 950, European Patent Applications EP 0 265 832, EP 0 269 977, EP 0 270 974, EP 0 273 125 and EP 0 339 550 or International Patent Applications WO 96/34108 and WO 97/34005.

Special preference is given, in accordance with the invention, to the use of 20K cellulase obtainable from Melanocarpus sp. or Myriococcum sp. That cellulase is known from International Patent Application WO 97/14804. As described therein, it has a molecular weight of about 20 kDa and exhibits, at 50° C. in the pH range from 4 to 9, at least 80% of its maximum activity, almost 50% of the maximum activity still being retained at pH 10. As likewise described therein, it can be isolated from *Melanocarpus albomyces* and produced in *Trichoderma reesei* transformants prepared by genetic engineering. Within the context of the present invention, it is also possible to use cellulases that exhibit a homology of more than 80% with respect to the said 20K cellulase. Special preference is given to the use of the cellulase Ecostone® from Röhm & Haas.

A particular further advantage, which is to be highly rated, of the 20K cellulase from Melanocarpus sp. or Myriococcum sp. that is preferably to be used in accordance with the invention is the fact that, when it is used, the reduction in wet-tearing strength of washed textiles is much less than when other cellulases are used even though it is not inferior to other cellulases in its colour-freshening and fabric-softening action.

The amount of cellulase, especially the said 20K cellulase, used is preferably such that a finished composition has a cellulolytic activity of from 1 NCU/g to 500 NCU/g (determinable by the hydrolysis of 1% by weight carboxymethyl cellulose at 50° C. and at neutral pH and determination of the reducing sugars released in the process by means of dinitrosalicylic acid, as described by M. J. Bailey et al. in Enzyme Microb. Technol. 3: 153 (1981); 1 NCU defines the amount of enzyme that produces reducing sugar in an amount that corresponds to 1 nmol of glucose per second), especially from 2 NCU/g to 400 NCU/g and more especially from 6 NCU/g to 200 NCU/g.

A composition according to the invention may, optionally, comprise further greying-inhibitors. Special mention should be made, in this respect, of cellulose derivatives. As suitable cellulose derivatives there may be used any known cellulose modified anionically or non-ionically with the aid of ether bonds, especially carboxymethyl cellulose, methyl cellulose, methyl hydroxyethyl cellulose or methyl hydroxypropyl cellulose, alone or in admixture with one another.

In that case, the amount of cellulose derivative in the compositions according to the invention is, in a preferred embodiment, typically from 0.1% by weight to 10% by weight, based on the entire composition. Special preference is given to amounts of from 0.5 to 5% by weight, more especially from 1% by weight to 4% by weight, in each case based on the entire composition.

As further greying-inhibitors, water-soluble colloids that are generally organic in nature are suitable, for example the water-soluble salts of polymeric carboxylic acids, size, gelatin, salts of ether carboxylic acids or ether sulfonic acids or starch or salts of acidic sulfuric acid esters of starch. Water-soluble, acid-group-containing polyamides are also suitable for the purpose. The weight ratio of those greying-inhibitors which are not derivatives of cellulose to cellulose derivatives, where present at all, is typically from 1:0.1 to 1:100, preferably from 1:1 to 1:50, especially from 1:5 to 1:20.

As perfume oils or fragrances there may be used, in the compositions, single aromatic compounds, for example the synthetic products of the ester, ether, aldehyde, ketone, alcohol and hydrocarbon types. Aromatic compounds of the ester type are, for example, benzyl acetate, phenoxyethyl isobutyrate, p-tert-butylcyclohexyl acetate, linalyl acetate, dimethyl benzyl carbinyl acetate (DMBCA), phenylethyl acetate, benzyl acetate, ethyl methyl phenyl glycinate, allyl cyclohexyl propionate, styrallyl propionate, benzyl salicylate, cyclohexyl salicylate, floramate, melusate and jasmecyclate. The ethers include, for example, benzyl ethyl ether and ambroxan; the aldehydes include, for example, the linear alkanals having from 8 to 18 C atoms, citral, citronellal, citronellyl oxyaldehyde, cyclamen aldehyde, lilial and bourgeonal; the ketones include, for example, the ionones, α-isomethyl ionone and methyl cedryl ketone; the alcohols include anethol, citronellol, eugenol, geraniol, linalool, phenyl ethyl alcohol and terpineol; the hydrocarbons include mainly the terpenes such as limonene and pinene. Preferably, however, mixtures of various aromatic substances are used, which together produce an attractive fragrant note.

Such perfume oils may also comprise natural aromatic substance mixtures, as are obtainable from vegetable sources, for example pine oil, citrus oil, jasmine oil, patchouli oil, rose oil or ylang-ylang oil. Also suitable are muscatel sage oil, camomile oil, clove oil, melissa oil, mint oil, cinnamon leaf oil, lime blossom oil, juniper berry oil, vetiver oil, olibanum oil, galbanum oil and labdanum oil and also orange blossom oil, neroliol, orange peel oil and sandalwood oil.

The general description of the perfumes that are suitable for use (see above) indicated, in general terms, the various substance classes of aromatic substances. In order to be perceptible, an aromatic substance must be volatile, for which, besides the nature of the functional groups and the structure of the chemical compound, the molecular weight also plays an important part. Most aromatic substances accordingly have molecular weights of up to about 200 Daltons, whilst molecular weights of 300 Daltons or more are rather an exception. Because of the differing volatility of aromatic substances, the odour of a perfume or fragrance composed of a plurality of aromatic substances changes in the course of evaporation, the sensations of odour being divided into a "top note", "middle note or body" and an "end note or dry out". Because the perception of smell is also based to a large extent on the intensity of the odour, the top note of a perfume or fragrance does not consist solely of readily volatile compounds, whilst the end note consists mostly of less volatile, that is to say adhering aromatic substances. In the composition of a perfume, more readily volatile aromatic substances can, for example, be bound to certain fixatives, as a result of which they are prevented from evaporating too quickly. In the following classification of aromatic substances as "more readily volatile" and "adhering" aromatic substances, therefore, no assertions are being made about the sensation of odour or whether the aromatic substance in question is perceived as a top note or middle note.

Adhering aromatic substances suitable for use in the context of the present invention are, for example, the ethereal oils such as angelica root oil, aniseed oil, arnica blossom oil, basil oil, bay oil, bergamot oil, champaca blossom oil, silver fir oil, silver fir cone oil, elemi oil, eucalyptus oil, fennel oil, fir needle oil, galbanum oil, geranium oil, gingergrass oil, guaiacum wood oil, gurjun balsam oil, helichrysum oil, ho oil, ginger oil, iris oil, cajuput oil, calamus oil, camomile oil, camphor oil, cananga oil, cardamom oil, cassia oil, pine needle oil, copaiba balsam oil, coriander oil, spearmint oil, caraway oil, cumin oil, lavender oil, lemongrass oil, lime oil, mandarin oil, melissa oil, musk seed oil, myrrh oil, clove oil, neroli oil, niaouli oil, olibanum oil, orange oil, oregano oil, palmarosa oil, patchouli oil, Peru balsam oil, petitgrain oil, pepper oil, peppermint oil, pimento oil, pine oil, rose oil, rosemary oil, sandalwood oil, celery oil, spike lavender oil, star anise oil, turpentine oil, thuja oil, thyme oil, verbena oil, vetiver oil, juniper berry oil, wormwood oil, wintergreen oil, ylang-ylang oil, hyssop oil, cinnamon oil, cinnamon leaf oil, citronella oil, lemon oil and cypress oil.

The higher-boiling or solid aromatic substances of natural or synthetic origin can, however, also be used in the context of the present invention as adhering aromatic substances or aromatic substance mixtures, that is to say as fragrances. Those compounds include the compounds mentioned below and mixtures thereof: ambrettolide, α-amyl cinnamic aldehyde, anethole, anisaldehyde, anisalcohol, anisole, anthranilic acid methyl ester, acetophenone, benzyl acetone, benzaldehyde, benzoic acid ethyl ester, benzophenone, benzyl alcohol, benzyl acetate, benzyl benzoate, benzyl formate, benzyl valerate, borneol, bornyl acetate, α-bromostyrene, n-decyl aldehyde, n-dodecyl aldehyde, eugenol, eugenol methyl ether, eucalyptol, farnesol, fenchone, fenchyl acetate, geranyl acetate, geranyl formate, heliotropin, heptynecarboxylic acid methyl ester, heptaldehyde, hydroquinone dimethyl ether, hydroxycinnamic aldehyde, hydroxycinnamic alcohol, indole, irone, isoeugenol, isoeugenol methyl ether, isosafrole, jasmone, camphor, carvacrol, carvone, p-cresol methyl ether, coumarin, p-methoxyacetophenone, methyl n-amyl ketone, methyl anthranilic acid methyl ester, p-methylacetophenone, methyl chavicol, p-methylquinoline, methyl β-naphthyl ketone, methyl n-nonyl acetaldehyde, methyl n-nonyl ketone, muscone, β-naphthol ethyl ether, β-naphthol methyl-ether, nerol, n-nonyl aldehyde, nonyl alcohol, n-octyl aldehyde, p-oxyacetophenone, pentadecanolide, β-phenyl ethyl alcohol, phenylacetaldehyde dimethylacetal, phenylacetic acid, pulegone, safrole, salicylic acid isoamyl ester, salicylic acid methyl ester, salicylic acid hexyl ester, salicylic acid cyclohexyl ester, santalol, skatole, terpineol, thymene, thymol, γ-undelactone, vanillin, veratrum aldehyde, cinnamic aldehyde, cinnamic alcohol, cinnamic acid, cinnamic acid ethyl ester, cinnamic acid benzyl ester.

The more readily volatile aromatic substances include especially the lower-boiling aromatic substances of natural or synthetic origin, which may be used alone or in admixture. Examples of more readily volatile aromatic substances are alkyl isothiocyanates (alkyl mustard oils), butanedione, limnonene, linalool, linalyl acetate and propionate, menthol, menthone, methyl n-heptenone, phellandrene, phenyl acetaldehyde, terpinyl acetate, citral, citronellal.

The compositions according to the invention contain aromatic substances preferably in amounts of from 0.05 to 5% by weight, especially in amounts of from 0.1 to 2% by weight. In order to produce an especially intense and long-lasting odour sensation on the laundry, special preference is given to the proportion of aromatic substances referred to above as adhering or higher-boiling in the fragrance formulations being at least 20% by weight, preferably at least 30% by weight.

The compositions may comprise UV absorbers which are taken up on the treated textiles and improve the resistance of the fibres to light and/or the resistance of other formulation constituents to light. UV absorbers are understood to mean organic substances (light-protective filters) that are capable of absorbing ultraviolet rays and re-emitting the absorbed energy in the form of longer-wavelength radiation, e.g. heat. Compounds that exhibit these desirable properties are, for example, compounds that are active as a result of radiationless deactivation and derivatives of benzophenone having substituents in the 2- and/or 4-position. In addition, substituted benzotriazoles, acrylates substituted by phenyl in the 3-position (cinnamic acid derivatives), where appropriate having cyano groups in the 2-position, salicylates, organic Ni complexes and natural substances such as umbelliferone and the body's own urocanic acid are also suitable. Biphenyl and, especially, stilbene derivatives, as described, for example, in European Patent Application EP 0 728 749 and commercially available as Tinosorb® FD or Tinosorb® FR from Ciba, are especially important. As UV-B absorbers there be mentioned 3-benzylidene camphor and 3-benzylidene nor-camphor and derivatives thereof, e.g. 3-(4-methylbenzylidene)camphor, as described in European Patent Specification EP 0 693 471; 4-aminobenzoic acid derivatives, preferably 4-(dimethyl-amino)benzoic acid 2-ethylhexyl ester, 4-(dimethylamino)benzoic acid 2-octyl ester and 4-(dimethylamino)benzoic acid amyl ester; esters of cinnamic acid, preferably 4-methoxy-cinnamic acid 2-ethylhexyl ester, 4-methoxycinnamic acid propyl ester, 4-methoxycinnamic acid isoamyl ester, 2-cyano-3,3-phenylcinnamic acid 2-ethylhexyl ester (octocrylene); esters of salicylic acid, preferably salicylic acid 2-ethylhexyl ester, salicylic acid 4-isopropylbenzyl ester, salicylic acid homomenthyl ester; derivatives of benzophenone, preferably 2-hydroxy-4-methoxybenzophenone, 2-hydroxy-4-methoxy-4'-methylbenzophenone, 2,2'-dihydroxy-4-methoxybenzophenone; esters of benzalmalonic acid, preferably 4-methoxybenzmalonic acid di-2-ethylhexyl ester; triazine derivatives such as, for example, 2,4,6-trianilino-(p-carbo-2'-ethyl-1'-hexyloxy)-1,3,5-triazine and octyl triazone, as described in European Patent Specification EP 0 818 450 or dioctyl butamido triazone (Uvasorb® HEB); propane-1,3-diones such as, for example, 1-(4-tert-butylphenyl)-3-(4'-methoxyphenyl)propane-1,3-dione; ketotricyclo[5.2.1.0]decane derivatives, as described in European Patent Specification EP 0 694 521. Also suitable are 2-phenylbenzimidazole-5-sulfonic acid and alkali metal, alkaline earth metal, ammonium, alkyl ammonium, alkanol ammonium and glucammonium salts thereof; sulfonic acid derivatives of benzophenones, preferably 2-hydroxy-4-methoxy-benzophenone-5-sulfonic acid and salts thereof; sulfonic acid derivatives of 3-benzylidene camphor such as, for example, 4-(2-oxo-3-bornylidenemethyl)benzenesulfonic acid and 2-methyl-5-(2-oxo-3-bornylidene)sulfonic acid and salts thereof.

As typical UV-A filters, there come into consideration, especially, derivatives of benzoyl methane such as, for example, 1-(4'-tert-butylphenyl)-3-(4'-methoxyphenyl)propane-1,3-dione, 4-tert-butyl-4'-methoxydibenzoyl methane (Parsol 1789), 1-phenyl-3-(4'-isopropyl-phenyl)-propane-1,3-dione and also enamine compounds, as described in German Patent Application DE 197 12 033. The UV-A and UV-B filters can also, if desired, be used in admixture with one another. In addition to the mentioned soluble substances, insoluble light-protective pigments, namely finely dispersed, preferably nano-sized metal oxides or salts, are also suitable for the purpose. Examples of suitable metal oxides are especially zinc oxide and titanium dioxide and, in addition, oxides of iron, zirconium, silicon, manganese, aluminium and cerium and mixtures thereof. Salts that may be used are silicates (talc), barium sulfate or zinc stearate. The oxides and salts are already used, in the form of pigments, for skin-care and skin-protecting emulsions and decorative cosmetics. The particles should have an average diameter of less than 100 nm, preferably between 5 and 50 nm and especially between 15 and 30 nm. They may have a spherical shape, but it is also possible to use particles that have an ellipsoidal shape or a shape that otherwise differs from the spherical form. The pigments may also be present in surface-treated form, that is to say hydrophilised or hydrophobised. Typical examples are coated titanium dioxides such as, for example, titanium dioxide T 805 (Degussa) or Eusolex® T2000 (Merck). Hydrophobic coating agents that come into consideration are, especially, silicones and, in particular, trialkoxyoctyl silanes or simethicones. Micronised zinc oxide is preferably used. Further suitable UV light-protective filters can be found in the review by P. Finkel in SÖFW-Journal 122, 543 (1996).

The UV absorbers, where present, are used especially in amounts of from 0.01% by weight to 5% by weight, preferably from 0.03% by weight to 1% by weight.

In addition, the compositions may also comprise further typical washing composition ingredients.

As fundamental ingredients, there may be mentioned surfactants that are also used, by virtue of their emulsifying action, in liquid compositions as already described. Preference is given to the use of non-ionic surfactants. If anionic surfactants are to be used, interactions between the anionic surfactants and the polymers must be borne in mind during formulation. The person skilled in the art of washing composition formulations will be highly familiar with such effects and so will be able to find suitable formulations without any problem.

Suitable anionic surfactants are especially soaps and those containing sulfate or sulfonate groups. Surfactants of the sulfonate type that come into consideration are especially $C_9$–$C_{13}$alkyl benzenesulfonates, olefin sulfonates, that is to say mixtures of alkene and hydroxyalkane sulfonates and disulfonates, as obtained, for example, from $C_{12}$–$C_{18}$ monoolefins having a terminally or internally located double bond by sulfonation with gaseous sulfur trioxide and subsequent alkaline or acid hydrolysis of the sulfonation products. Also suitable are alkane sulfonates obtained from $C_{12}$–$C_{18}$alkanes, for example by sulfochlorination or sulfoxidation with, respectively, subsequent hydrolysis and neutralisation. Also suitable are the esters of α-sulfo fatty acids (ester sulfonates), for example the α-sulfonated methyl esters of hydrogenated coconut, palm kernel or tallow fatty acids, which are prepared by α-sulfonation of the methyl esters of fatty acids of vegetable and/or animal origin having from 8 to 20 C atoms in the fatty acid molecule and subsequent neutralisation to form water-soluble mono-salts. Preference is given to the α-sulfonated esters of hydrogenated coconut, palm, palm kernel or tallow fatty acids, it also being possible for sulfonation products of unsaturated fatty acids, for example oleic acid, to be present in small amounts, preferably in amounts not exceeding about 2 to 3% by weight. Special preference is given to α-sulfo fatty acid alkyl esters that have an alkyl chain of no more than 4 C atoms in the ester group, for example methyl esters, ethyl esters, propyl esters and butyl esters. The use of methyl esters of α-sulfo fatty acids (MES), and also saponified di-salts thereof, is especially advantageous.

Further suitable anionic surfactants are sulfonated fatty acid glycerol esters comprising mono-, di- and tri-esters and mixtures thereof, as are obtained in the preparation by esterification of a monoglycerol with from 1 to 3 moles of fatty acid or in the trans-esterification of triglycerides with from 0.3 to 2 moles of glycerol.

Alk(en)yl sulfates to which preference is given are the alkali metal salts and especially the sodium salts of sulfuric acid semi-esters of $C_{12}$–$C_{18}$ fatty alcohols, for example from coconut fatty alcohol, tallow fatty alcohol, lauryl, myristyl, cetyl or stearyl alcohol, or of $C_{10}$–$C_{20}$ oxo alcohols and semi-esters of secondary alcohols having that chain length. Preference is given also to alk(en)yl sulfates of the said chain length that contain a synthetic straight-chain alkyl radical produced on a petrochemical basis, which have analogous breakdown characteristics to the suitable compounds based on fat-chemical raw materials. From the point of view of washing technology, special preference is given to $C_{12}$–$C_{16}$alkyl sulfates and $C_{12}$–$C_{15}$alkyl sulfates and also to $C_{14}$–$C_{15}$alkyl sulfates. Suitable anionic surfactants are also 2,3-alkyl sulfates that are prepared, for example, in accordance with USA Patent Specifications U.S. Pat. No. 3,234,258 or U.S. Pat. No. 5,075,041 and can be obtained as commercial products of the Shell Oil Company under the name DAN®.

Also suitable are the sulfuric acid monoesters of straight-chain or branched $C_7$–$C_{21}$ alcohols ethoxylated with from 1 to 6 moles of ethylene oxide, such as 2-methyl-branched $C_9$–$C_{11}$ alcohols with, on average, 3.5 moles of ethylene oxide (EO) or $C_{12}$–$C_{18}$ fatty alcohols with from 1 to 4 EO. Because of their high foaming characteristics, they are normally used in washing and cleaning compositions only in relatively small amounts, for example in amounts of from 1 to 5% by weight.

The preferred anionic surfactants also include the salts of alkyl sulfosuccinic acid, which can also be referred to as'sulfosuccinates or sulfosuccinic acid esters and which are monoesters and/or diesters of sulfosuccinic acid with alcohols, preferably fatty alcohols and, especially, ethoxylated fatty alcohols. Preferred sulfosuccinates contain $C_8$ to $C_{18}$ fatty alcohol radicals or mixtures thereof. Especially preferred sulfosuccinates contain a fatty alcohol radical derived from ethoxylated fatty alcohols that, when considered on their own, constitute non-ionic surfactants. Again, special preference is given to sulfosuccinates in which the fatty alcohol radicals are derived from ethoxylated fatty alcohols having a restricted homologue distribution. It is likewise also possible to use alk(en)yl succinic acid having preferably from 8 to 18 carbon atoms in the alk(en)yl chain or salts thereof.

Further anionic surfactants that come into consideration are fatty acid derivatives of amino acids, for example of N-methyltaurine (taurides) and/or of N-methylglycine (sarcosides). Special preference is given to the sarcosides and sarcosinates and, of those, more espeically, to sarcosinates of higher and optionally mono- or poly-unsaturated fatty acids such as oleyl sarcosinate.

Further anionic surfactants that come into consideration are, especially, soaps. Saturated fatty acid soaps such as the salts of lauric acid, myristic acid, palmitic acid, stearic acid, hydrogenated erucic acid and behenic acid and especially soap mixtures derived from natural fatty acids, for example coconut, palm kernel or tallow fatty acids, are especially suitable.

The anionic surfactants, including the soaps, may be present in the form of their sodium, potassium or ammonium salts and in the form of soluble salts of organic bases such as mono-, di- or tri-ethanolamine. The anionic surfactants are preferably present in the form of their sodium or potassium salts, especially in the form of the sodium salts.

As non-ionic surfactants there are preferably used the surfactants already described hereinbefore.

The compositions according to the invention may further comprise builder constituents, special preference being given to the use of organic builders.

Organic builder substances that are suitable for use are, for example, polycarboxylic acids suitable for use in the form of their sodium salts, polycarboxylic acids being understood to mean those carboxylic acids that carry more than one acid function. They are, for example, citric acid, adipic acid, succinic acid, glutaric acid, malic acid, tartaric acid, maleic acid, fumaric acid, sugar acids, aminocarboxylic acids, nitrilotriacetic acid (NTA), provided there are no objections to such use on ecological grounds, and mixtures thereof. Preferred salts are the salts of polycarboxylic acids such as citric acid, adipic acid, succinic acid, glutaric acid, tartaric acid, sugar acids and mixtures thereof.

The acids per se may also be used. Besides their builder action, the acids also typically have the property of an acidification component and accordingly are also used for adjusting washing or cleaning compositions to a lower and milder pH. In that respect, special mention may be made of citric acid, succinic acid, glutaric acid, adipic acid, gluconic acid and any mixture thereof.

Also suitable as builders are polymeric polycarboxylates; these are, for example, the alkali metal salts of polyacrylic acid or of polymethacrylic acid, for example those having a relative molecular weight of from 500 to 70 000 g/mol.

The molecular weights mentioned for polymeric polycarboxylates are, in the context of this specification, weight-average molecular weights $M_w$ of the acid form in question that have in each case been determined by gel permeation chromatography (GPC) in which a UV detector has been used. The measurement was carried out against an external polyacrylic acid standard which, because of its structural relatedness to the polymers investigated, provides realistic molecular weight values. Those figures differ markedly from the molecular weight figures for which polystyrene sulfonic acids are used as the standard. The molecular weights measured against polystyrene sulfonic acid are generally markedly higher than the molecular weights indicated in this specification.

Suitable polymers are especially polyacrylates that preferably have a molecular weight of from 2000 to 20 000 g/mol. Of that group, preference may in turn be given, in view of their superior solubility, to the short-chain polyacrylates having molecular weights of from 2000 to 10 000 g/mol and especially from 3000 to 5000 g/mol.

Also suitable are copolymeric polycarboxylates, especially those of acrylic acid with methacrylic acid and of acrylic acid or methacrylic acid with maleic acid. Copolymers of acrylic acid with maleic acid that contain from 50 to 90% by weight acrylic acid and from 50 to 10% by weight maleic acid have proved to be especially suitable. Their relative molecular weight, based on free acids, is generally from 2000 to 70 000 g/mol, preferably from 20 000 to 50 000 g/mol and especially from 30 000 to 40 000 g/mol.

The (co)polymeric polycarboxylates may be used either in the form of a powder or in the form of an aqueous solution. The content of (co)polymeric polycarboxylates in the compositions is preferably from 0.5 to 20% by weight, especially from 3 to 10% by weight.

In order to improve the solubility in water, the polymers may also comprise allylsulfonic acids such as, for example, allyloxybenzenesulfonic acid and methallylsulfonic acid, as monomer.

Special preference is given also to biologically degradable polymers comprising more than two different monomer units, for example those that comprise as monomers salts of acrylic acid and maleic acid and also vinyl alcohol or vinyl alcohol derivatives or that comprise as monomers salts of acrylic acid and 2-alkylallylsulfonic acid and also sugar derivatives.

Further preferred copolymers are those that are described in German Patent Applications DE-A-43 03 320 and DE-A-44 17 734 and comprise as monomers preferably acrolein and acrylic acid/acrylic acid salts or acrolein and vinyl acetate.

As further preferred builder substances there may likewise be mentioned polymeric aminodicarboxylic acids, salts thereof or precursor substances thereof. Special preference is given to polyaspartic acids and salts and derivatives thereof, which in German Patent Application DE-A-195 40 086 are disclosed as having a bleach-stabilising action in addition to co-builder properties.

Further suitable builder substances are polyacetals that can be obtained by reacting dialdehydes with polyolcarboxylic acids having from 5 to 7 C atoms and at least 3 hydroxyl groups. Preferred polyacetals are obtained from dialdehydes such as glyoxal, glutaraldehyde, terephthalaldehyde and mixtures thereof and from polyolcarboxylic acids such as gluconic acid and/or glucoheptonic acid.

Further suitable organic builder substances are dextrins, for example oligomers and polymers of carbohydrates, which can be obtained by partial hydrolysis of starches. The hydrolysis can be carried out in accordance with conventional, for example acid- or enzyme-catalysed, methods. They are preferably hydrolysis products having average molecular weights in the range from 400 to 500 000 g/mol, with preference being given to a polysaccharide having a dextrose equivalent (DE) in the range from 0.5 to 40, especially from 2 to 30, DE being a customary measure of the reducing action of a polysaccharide compared to dextrose, which has a DE of 100. Maltodextrins having a DE of between 3 and 20 and dry glucose syrups having a DE of between 20 and 37 as well as so-called yellow dextrins and white dextrins having relatively high molecular weights in the range from 2000 to 30 000 g/mol are suitable for use.

The oxidised derivatives of such dextrins are reaction products thereof with oxidising agents that are capable of oxidising at least one alcohol function of the saccharide ring to form the carboxylic acid function. Such oxidised dextrins and processes for their preparation are known from numerous publications. Also suitable is an oxidised oligosaccharide according to German Patent Application DE-A-196 00 018. A product oxidised at $C_6$ of the saccharide ring may be especially advantageous.

Oxydisuccinates and other derivatives of disuccinates, preferably ethylenediamine disuccinate, are also further suitable co-builders, with ethylenediamine N,N'-disuccinate (EDDS) preferably being used in the form of its sodium or magnesium salts. Furthermore, preference is also given in this context to glycerol disuccinates and glycerol trisuccinates. Suitable amounts for use in zeolite-containing and/or silicate-containing formulations are from 3 to 15% by weight.

Further organic co-builders that are suitable for use are, for example, acetylated hydroxy-carboxylic acids and salts thereof, which may also, where appropriate, be present in lactone form and which contain at least 4 carbon atoms and at least one hydroxy group and a maximum of two acid groups. Such co-builders are described, for example, in International Patent Application WO 95/20029.

A further substance class having co-builder properties is represented by the phosphonates. These are especially hydroxyalkane and aminoalkane phosphonates. Among the hydroxyalkane phosphonates, 1-hydroxyethane 1,1-diphosphonate (HEDP) is especially important as a co-builder. It is used preferably in the form of a sodium salt, the disodium salt having a neutral pH and the tetrasodium salt having an alkaline pH (pH 9). Suitable aminoalkane phosphonates are preferably ethylenediamine tetramethylene phosphonate (EDTMP), diethylenetriamine pentamethylene phosphonate (DTPMP) and higher homologues thereof. They are used preferably in the form of sodium salts of neutral pH, e.g. in the form of the hexasodium salt of EDTMP or in the form of the hepta- and octa-sodium salt of DTPMP. The builder from the class of the phosphonates that is preferably used is HEDP. The aminoalkane phosphonates have, in addition, a pronounced heavy-metal-binding capability. The use of aminoalkane phosphonates, especially DTPMP, or mixtures of the mentioned phosphonates, may accordingly be preferred, especially when the compositions also comprise bleaches. The use of such phosphonates in the compositions according to the invention is especially preferred.

In addition, any compound that is capable of forming complexes with alkaline earth metal ions may be used as co-builder.

Enzymes that come into consideration for use in the compositions according to the invention, besides the cellulases, also include those from the class of the proteases, lipases, amylases and mixtures thereof. Especially suitable are enzymatic active ingredients obtained from strains of bacteria or fungi such as *Bacillus subtilis, Bacillus licheniformis* and *Streptomyces griseus*. Preference is given to use of proteases of the subtilisin type and especially proteases that are obtained from *Bacillus lentus*. Of special interest are enzyme mixtures, for example of cellulase and protease or of cellulase and lipase or of cellulase, protease and amylase or of cellulase, protease and lipase or of cellulase, protease, amylase and lipase. It is also possible for peroxidases and/or oxidases to be present. The enzymes may be adsorbed onto carrier substances and/or embedded in encapsulating substances in order to protect them against premature breakdown.

In addition, components that have a positive effect on the ability to wash out oil and grease (so-called soil repellents) may also be used. That effect becomes especially clear when a textile that has already been washed several times before with a washing or cleaning composition according to the invention comprising such an oil- and grease-dissolving component becomes soiled. The preferred oil- and grease-dissolving components include, for example, the non-ionic cellulose ethers described hereinbefore as greying-inhibiting adjuvants, such as methyl cellulose and methyl hydroxypropyl cellulose containing from 15 to 30% by weight methoxyl groups and from 1 to 15% by weight hydroxypropoxyl groups, in each case based on the non-ionic cellulose ether, and also the polymers, known from the prior art, of phthalic acid and/or terephthalic acid and derivatives thereof, especially polymers of ethylene terephthalates and/or polyethylene glycol terephthalates or anionically and/or non-ionically modified derivatives thereof. Of those, special preference is given to the sulfonated derivatives of phthalic acid polymers and terephthalic acid polymers.

In order to improve the aesthetic impression of the compositions, they may be coloured using suitable colouring agents. Preferred colouring agents, the selection of which will not present any difficulty to the person skilled in the art, will have a high level of storage stability and insensitivity to the other ingredients present in the compositions and to light, and no marked substantivity with respect to textile fibres, so that the latter do not take up any colour.

The present invention relates also to a method of washing laundry in which there is also used, besides a liquid or solid washing composition, a textile-care composition as described above.

There are various embodiments of the method which are advantageous. Especially for the purpose of treating new textiles that have not yet been washed, it is advantageous for the textiles to be pretreated with the textile-care composition before being treated with a liquid or solid washing composition. As a result, especially good colour-fixing is achieved and the new textiles are accordingly prevented from bleeding.

When the textile-care composition is used in the actual washing procedure, the use thereof in the main washing operation in addition to a customary liquid or solid washing composition is advantageous because, in that way, the action of the actual washing composition is supplemented by the care properties of the additive according to the invention. Especially when the perfuming of the laundry is of major importance, it is advantageous to use a liquid or solid washing composition in the main washing operation and to use the textile-care composition according to the invention in the rinsing operation. In that way colour-fixing for the next washing procedure is simultaneously carried out in the rinsing operation.

The following Example serves to illustrate the composition according to the invention and the washing method according to the invention in greater detail:

EXAMPLE

A textile-care composition according to the invention has the following composition:

| | |
|---|---|
| 5% by weight | Tinofix CL ® |
| 0.05% by weight | 20K cellulase |
| 0.5% by weight | perfume preparation |
| 10% by weight | 1,2-propylene glycol |
| 1% by weight | sodium acetate |
| remainder to 100% by weight | water, emulsifier |

Tinofix CL ®: oligomer/polymer mixture of imidazolidine units; commercial product of Ciba Spezialitätenchemie AG
20K cellulase: Ecostone ®; available from Röhm & Haas In the case of pretreatment of new coloured textiles, the care composition results in almost complete prevention of bleeding of the colours during washing. When used regularly during washing, in the main washing operation or in the rinsing operation, the composition results in the colours of the textiles remaining fresh for longer, in greying of the textiles being reduced and in the textile surface retaining a pleasant feel.

The invention claimed is:

1. Composition for textile care, comprising at least one cellulase and at least one colour-fixing polymer, wherein the colour-fixing polymer contains imidazolidine units.

2. Composition according to claim 1, wherein the colour-fixing polymer is present in amounts of from 0.1 to 25% by weight and consists substantially of imidazolidine units.

3. Composition according to claim 1, wherein the composition comprises an emulsifier and a solvent.

4. Composition according to claim 1, wherein the cellulase exhibits, at 50° C. and in the pH range from 4 to 9, at least 80% of its maximum activity, almost 50% of the maximum activity still being retained at pH 10.

5. Composition according to claim 1, wherein the cellulase is the 20K celluLase from Melanocarpus sp. or Myriococcum sp.

6. Composition according to claim 1, wherein the amount of cellulase present is such that the composition has a cellulolytic activity of from 1 NCU/g to 500 NCU/g.

7. Composition according to claim 1, which further comprises celluloses, alone or in admixture with one another, which have been modified anionically or non-ionically by means of ether bonds.

8. Composition according to claim 5, wherein the modified celluloses are present in amounts of from 0.1% by weight to 10% by weight based on the entire composition.

9. Composition according to claim 1, which further comprises aromatic fragrance substances in amounts of from 0.05 to 5% by weight, wherein the amount of adhering or higher-boiling aromatic substances in the fragrance substances is at least 20% by weight.

10. Composition according to claim 1, which in addition comprises UV absorbers in amounts of from 0.01% by weight to 5% by weight.

11. A method of washing laundrywhich comprises the step of treating said laundry with a textile-care composition according to claim 1 before, during or after washing said laundry with a liquid or solid washing composition.

12. A method according to claim 11, wherein the laundry is new textile material which is pretreated with the textile-care composition before washing with the liquid or solid washing composition.

13. A method according to claim 11, wherein, during the laundry washing step, in addition to the liquid or solid washing composition the textile-care composition is also present.

14. A method according to claim 11 wherein, in the laundry washing step, the liquid or solid washing composition is used, and the textile-care composition is used in a subsequent rinsing step.

15. Composition according to claim 1, wherein the colour-fixing polymer is TINOFIX CL®, which is an oligomer/polymer mixture comprising imidaz.olidine units.

16. Composition according to claim 3, wherein the emulsifier is a non-ionic emulsifier and the solvent is water.

17. Composition according to claim 7, wherein the modified cellulose is carboxymethyl cellulose, methyl cellulose, methyl hydroxyethyl cellulose or methyl hydroxypropyl cellulose, alone or in admixture with one another.

* * * * *